United States Patent [19]

Cheng

[11] Patent Number: 5,047,268

[45] Date of Patent: Sep. 10, 1991

[54] LIQUID-FILLED DECORATIVE STEMMED ARTIFICIAL FLOWERS

[76] Inventor: Peter S. C. Cheng, 5 Ross Street, Toronto, Ontario, Canada, M5T 1Z8

[21] Appl. No.: 491,212

[22] Filed: Mar. 9, 1990

[51] Int. Cl.[5] ..... A41G 1/00

[52] U.S. Cl. ..... 428/24; 156/61

[58] Field of Search ..... 428/24, 25, 26; 156/61

[56] References Cited

U.S. PATENT DOCUMENTS

| | | | |
|---|---|---|---|
| 1,897,942 | 2/1933 | Pirrone | 428/24 X |
| 2,140,327 | 12/1938 | Mould | 272/8 N |
| 2,698,802 | 1/1955 | Boone | 428/24 X |
| 3,463,624 | 8/1969 | Labino | 428/24 X |
| 4,142,383 | 3/1979 | Eberhart | 428/28 X |
| 4,208,888 | 6/1980 | Erdman et al. | 428/28 X |
| 4,631,210 | 12/1986 | McGee et al. | 156/61 X |

*Primary Examiner*—Henry F. Epstein

*Attorney, Agent, or Firm*—Kirschstein, Ottinger, Israel & Schiffmiller

[57] ABSTRACT

A decorative, stemmed, artificial flower has a flower-like, hollow head filled with a colored liquid, as well as hollow, leaf-like elements also filled with a colored liquid, mounted on a stem which supports the head. The colored liquid is visible through transparent wall portions of the head and leaf-like elements.

17 Claims, 1 Drawing Sheet

FIG. 1
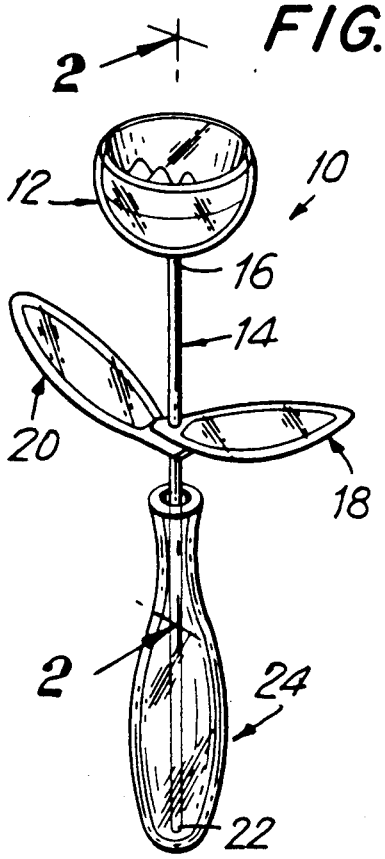
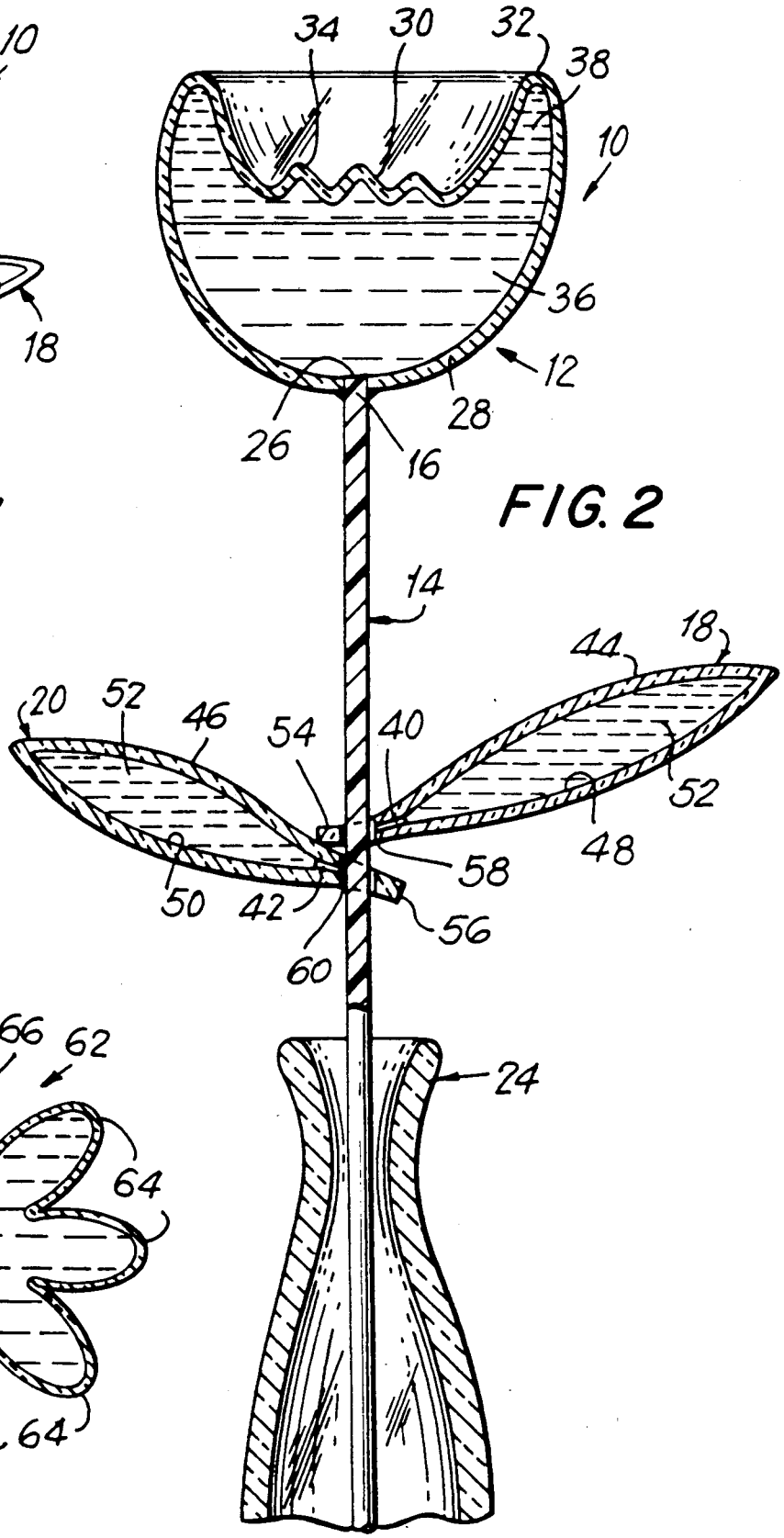
FIG. 2
FIG. 3
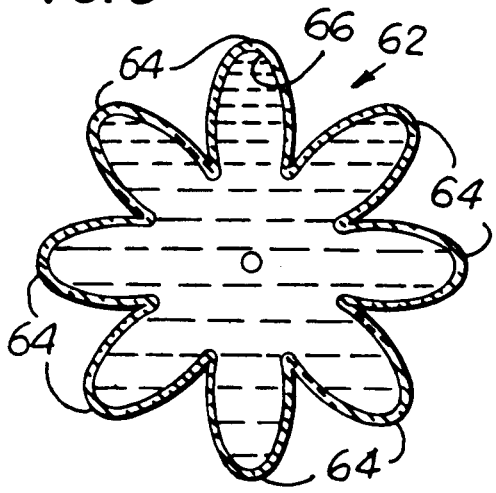

LIQUID-FILLED DECORATIVE STEMMED ARTIFICIAL FLOWERS

BACKGROUND OF THE INVENTION

1. Field of the Invention

This invention generally relates to artificial flowers and, more particularly, to a stemmed artificial flower having internal portions thereof filled with a colored liquid for decorative purposes.

2. Description of Related Art

Natural flowers, ones cut from their plants, have a short life span. Hence, for long-lasting display purposes, the beauty of natural flowers has been captured in artificial flowers. Artificial flowers have been rendered of many materials, for example, silk, paper, plastic, glass, etc. Although many artificial flowers are quite decorative in appearance, the need persists for an attractive artificial flower of high esthetic appeal and of low cost.

SUMMARY OF THE INVENTION

1. Objects of the Invention

It is a general object of this invention to provide a decorative stemmed artificial flower of attractive appearance.

It is another object of this invention to fill internal portions of an artificial flower with a colored liquid.

Another object of this invention is to reliably prevent liquid-filled internal portions of an artificial flower from leakage.

A further object of this invention is to provide an artificial flower of inexpensive construction.

2. Features of the Invention

In keeping with these objects, and others which will become apparent hereinafter, one feature of this invention resides, briefly stated, in a decorative stemmed artificial flower which comprises flower-like head, an elongated stem having one end connected to the head, and a liquid contained within the head.

The head has an inlet through which the liquid is introduced. The head also has light-transmissive wall portions bounding an interior in which the liquid is contained. The liquid is visible through the wall portions of the head. The stem supportably displays the head and the liquid contained therein.

In a preferred embodiment, the wall portions include a base through which the inlet extends. Said one end of the stem is connected to the base in a sealing, overlying relationship with the inlet. The stem thus reliably prevents water leakage from the head and, at the same time, conceals the presence of the inlet. The presence of the inlet would detract from the appearance of the flower and, hence, by plugging the inlet with the stem, there is no longer any inlet to mar the appearance of the flower.

The wall portions are preferably constituted of a transparent, synthetic, plastic material. The plastic material may be a hard plastic or a flexible plastic. Other light-transmissive materials such as glass are also contemplated.

The liquid itself is preferably a colored liquid such as colored water. In a preferred embodiment, the liquid has a greater viscosity than water. For example, colored mineral oil may be employed. The liquid may either completely or partially fill the interior of the head. The liquid may also comprise a mixture of immiscible colored liquids such as water and oil, or two liquids of different viscosities.

The head itself may have any blossom-like configuration. In one embodiment, the head has a tulip-like configuration, having a dish-like base and a concave scalloped top. In another embodiment, the head has a multipetal daisy-like configuration. Each petal bounds an internal chamber in which the liquid is contained.

The stem is a transparent, synthetic, plastic material, solid rod. It is also contemplated that the interior of the rod be hollow so that liquid can be introduced therein.

The flower may further comprise at least one leaf-like element, and preferably a pair of such elements, mounted on the stem away from the head. Each leaf-like element has an inlet port and light-transmissive walls bounding an internal compartment. A fluid is introduced via the inlet port into each internal compartment for containment therein. The fluid is visible through the walls of each leaf-like element. Preferably, the liquid within the head and the fluid in each leaf-like element are differently colored. The fluid is preferably a colored liquid such as water or mineral oil.

Each leaf-like element is frictionally mounted on the stem. Each element has an extension having a mounting hole through which the stem extends.

The resulting liquid-filled stemmed artificial flower has a high esthetic appeal, and is inexpensive to produce.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of a liquid-filled, decorative, stemmed, artificial flower according to one embodiment of this invention, the flower being mounted in a bud vase for display;

FIG. 2 is an enlarged sectional view taken on line 2—2 of FIG. 1; and FIG. 3 is an enlarged top plan view of another embodiment of a liquid-filled, artificial flower according to this invention.

DETAILED DESCRIPTION OF THE PREFERRED EMBODIMENTS

Referring now to the drawings, reference numeral 10 generally identifies a decorative, stemmed, artificial flower having a flower-like head 12, an elongated stem 14 having an upper end 16 connected to the head 12, a pair of leaf-like elements 18, 20 mounted on the stem 14 away from the head 12, and a liquid contained in various internal portions of the flower. The lower end 22 of the stem 14 is inserted into a bud vase 24 for display purposes.

As best shown in FIG. 2, the head 12 has an inlet 26 extending through a generally dish-like base wall 28. A concave, generally dish-like, scalloped, top wall 30 overlies and is integral with the base wall 28. The head of FIG. 2 has a generally tulip-like configuration, having an outer rim 32 resembling outer petals, and inner raised projections 34 resembling inner petals. The base wall 28 and the top wall 30 are constituted of a light-transmissive material, for example, transparent synthetic plastic. Other light-transmissive materials, such as glass, are also contemplated. The plastic material may be a hard plastic or a soft, flexible, deformable plastic.

Prior to attaching the stem 14 to the head 12, the aforementioned liquid is introduced via the inlet 26 into the interior of the head that is bounded by the base wall 28 and the top wall 30. The needle of a syringe having the liquid in its barrel pierces through the base wall 28, thereby forming the inlet 26. Upon depressing a plunger of the syringe, the liquid fills the interior of the head 12 for containment therein. The liquid is visible through the light-transmissive wall portions of the head.

The liquid is advantageously colored so as to render the same more visible through the head. Colored water, or a liquid having a higher viscosity such as mineral oil, may be used. As shown in FIG. 2, the liquid may comprise a mixture of two immiscible colored liquids such as a lower body 36 of water and an upper body 38 of oil. The liquid may either partially, or preferably completely, fill the interior of the head.

After the liquid has been introduced into the head, the needle of the syringe is removed therefrom. The now-open inlet must be sealed to prevent liquid leakage. For that purpose, the upper end 16 of the stem 14 is connected, preferably by heat-sealing, to the base wall 28 in a sealing overlying relationship with the inlet 26. The inlet 26 is therefore reliably plugged. The stem affirmatively prevents liquid leakage. The upper end 16 of the stem conceals the presence of the inlet. If the inlet 26 were located away from the attachment point of the upper end 16 of the stem, such presence would detract from the overall esthetic appearance of the flower since it would leave an unattractive "scar" on the head.

The stem 14 is constituted of a transparent, synthetic, plastic material solid rod. Preferably, the rod is of a rigid plastic in order to supportably display the head and the liquid contained therein in a generally upright orientation. It is also contemplated that the interior of the stem 14 be hollow so that additional liquid may be introduced therein for an even greater stylized appearance.

Each leaf-like element 18, 20 is a discrete element separately mounted on the stem. The elements 18, 20 have inlet ports 40, 42 and light-transmissive walls 44, 46 bounding internal compartments 48, 50, respectively. A fluid 52 is introduced separately via the inlet ports 40, 42 into each internal compartment 48, 50 for containment therein. The fluid 52 is preferably a colored liquid such as water or mineral oil, or a mixture of colored liquids, and is visible through the walls of the leaf-like elements 18, 20. Advantageously, the fluid 52 is differently colored from the liquid which fills the interior of the head 12.

The leaf-like elements 18, 20 have extensions 54, 56 having mounting holes 58, 60 through which the stem 14 extends with an interference-type friction fit. Thus, the elements 18, 20 are slid to any desired position along the elongation of the stem 14 and are frictionally secured in said desired position. It will be noted that once the elements 18, 20 are mounted on the stem 14, the stem also conceals, at least partially, the presence of the inlets 40, 42, thereby further contributing to the overall esthetic quality of the flower.

The head 12, as previously noted, may have any flower-like shape, such as the tulip-like shape depicted in FIGS. 1 and 2. In a variant construction, the head, as shown in FIG. 3, has a daisy-like configuration, having multiple petals arranged in a star-like or star-burst pattern. The daisy-like head 62 has multiple petals 64, each petal having wall portions bounding an internal chamber 66. All of the internal chambers 66 are in fluid communication with the interior of the head. Other blossom-like or simulated flower-like shapes for the head are within the spirit of this invention.

Although the choice of colors for the liquids is virtually infinite, in one preferred embodiment, each leaf-like element 18, 20 is filled with green-colored liquid to simulate natural leaves, and the liquid introduced into the head 12 may be any color of the rainbow and variations thereof.

It is also desirable that the liquid, too, be at least partly light-transmissive to enable sunlight or artificial light to pass through and be scattered within the liquid to create interesting visual effects. For an enhanced optical effect, glitter-type particles having reflective surfaces, or particles of any type, may be introduced into the liquid. Colloidal suspensions are also contemplated.

It will be understood that each of the elements described above, or two or more together, also may find a useful application in other types of constructions differing from the types described above.

While the invention has been illustrated and described as embodied in liquid-filled decorative stemmed artificial flowers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A decorative, stemmed, artificial flower, comprising:

a flower-shaped head having an inlet and light-transmissive wall portions bounding an interior;

a colored liquid introduced via the inlet into the interior of the head for sealed containment therein, said colored liquid being visible through the wall portions of the head; and an elongated stem having one end connected to the head, for supporting and displaying the head and the liquid sealingly contained therein.

2. The flower according to claim 1, wherein the wall portions include a base through which the inlet extends, and wherein said one end of the stem is connected to the base in a sealing, overlying relationship with the inlet.

3. The flower according to claim 1, wherein the wall portions are constituted of a transparent, synthetic plastic material.

4. The flower according to claim 1, wherein the liquid completely fills the interior of the head.

5. The flower according to claim 1, wherein the liquid partially fills the interior of the head.

6. The flower according to claim 1, wherein the liquid is a mixture of immiscible colored liquids.

7. The flower according to claim 1, wherein the liquid is a mineral oil.

8. The flower according to claim 1, wherein the wall portions include a dish-shaped base and a concave, scalloped top.

9. The flower according to claim 1, wherein the wall portions have a multi-petal configuration, each petal bounding an internal chamber in which the liquid is contained.

10. The flower according to claim 1, wherein the stem is a transparent, synthetic plastic material rod.

11. The flower according to claim 1; and further comprising at least one leaf-shaped element mounted on the stem away from the head, said leaf-shaped element having an inlet port and light-transmissive walls bounding an internal compartment; and also comprising another liquid introduced via the inlet port into the internal compartment for containment therein, said other liquid being visible through the walls of the leaf-shaped element.

12. The flower according to claim 11, wherein the liquids are differently-colored.

13. The flower according to claim 11, wherein the leaf-shaped element has an extension formed with a mounting hole through which the stem extends with an interference friction fit.

14. A decorative, stemmed artificial flower, comprising:

a flower-shaped head having a liquid inlet and light-transmissive wall portions bounding an interior;

a colored liquid introduced via the liquid inlet into the interior of the head for sealed containment therein, said colored liquid being visible through the wall portions of the head; and an elongated stem having one end connected to the head in a sealing, overlying relationship with the liquid inlet, said stem supportably displaying the head and the colored liquid sealingly contained therein.

15. The flower according to claim 14, and further comprising at least one leaf-shaped element mounted on the stem away from the head, said leaf-shaped element having an inlet port and light-transmissive walls bounding an internal compartment; and also comprising another liquid introduced via the inlet port into the internal compartment for containment therein, said other liquid being visible through the walls of the leaf-shaped element.

16. The flower according to claim 14, wherein the liquids are differently-colored.

17. The flower according to claim 14, wherein the leaf-shaped element has an extension formed with a mounting hole through which the stem extends with an interference friction fit.

* * * * *